United States Patent [19]

Strauss

[11] 4,071,051

[45] Jan. 31, 1978

[54] UNDULATED SHED LOOM WITH FILLING-THREAD CLAMPING DEVICE

[75] Inventor: Edgar Strauss, Agincourt, Canada

[73] Assignee: Ruti Machinery Works Ltd., Ruti, Switzerland

[21] Appl. No.: 693,511

[22] Filed: June 7, 1976

[30] Foreign Application Priority Data

June 17, 1975 Switzerland ..... 7823/75

[51] Int. Cl.[2] ..... D03D 45/50

[52] U.S. Cl. ..... 139/436; 139/194

[58] Field of Search ..... 139/116, 194, 426, 436, 139/450

[56] References Cited

U.S. PATENT DOCUMENTS

| | | | |
|---|---|---|---|
| 2,519,274 | 8/1950 | Moessinger | 139/194 |
| 3,845,790 | 11/1974 | Filter | 139/194 |
| 3,851,679 | 12/1974 | Titou et al. | 139/436 |
| 3,939,877 | 2/1976 | Demuth | 139/194 |

*Primary Examiner*—Henry S. Jaudon

*Attorney, Agent, or Firm*—Donald D. Denton

[57] ABSTRACT

A filling-thread clamping device in the form of a tong-like thread gripper which is displaceable back and forth along a line lying in the central plane of the warp threads.

5 Claims, 5 Drawing Figures

UNDULATED SHED LOOM WITH FILLING-THREAD CLAMPING DEVICE

BACKGROUND OF THE INVENTION

The present invention relates to an undulated shed loom having a filling-thread clamping device arranged on the entrance end of the shed, adapted to clamp the filling thread fast behind each shuttle so as to convey this part of the filling thread to the fell of the cloth, and to hold the filling thread fast until it has been woven into the cloth.

A first known filling-thread clamping device of the aforementioned type used on an undulated shed loom with rotary reed consists of two oppositely rotating conveyor belts which contact each other along a conveyance path which is directed towards the inlet end of the rotary reed. The filling thread extending out of the shuttle is fed, immediately after the filling of the shuttles, into the conveyance path between the conveyor belts and conveyed to the fell of the cloth.

This known filling-thread clamping device has the disadvantage, in addition to the fact that it takes up an excessive amount of space, that precise synchronization is required between the shuttle filling device, the filling-thread cutting device, the drive of the conveyor belts, and the shuttle transport. Furthermore, with this filling-thread clamping device the filling thread extending out of the rear part of the shuttles, when it is fed between the conveyor belts, must be taut and extend a relatively long distance out of the shuttle. This known filling-thread clamping device can thus be used only for very special shuttle-filling and shuttle-feed systems and is, for instance, not suitable for systems in which the filling thread cannot be offered in a taut state and with the required long length to the clamping device. The fact that the filling thread must be offered the clamping device in a relatively large length furthermore means that relatively long filling-thread fringes protrude on the selvage on the entrance side, which fringes must be shortened by an additional cutter.

A second known filling-thread clamping device, of the aforementioned type used on an undulated shed loom with rotary reed, consists of a feed disk, arranged on the drive shaft of the rotary reed and provided with driving teeth for the filling thread, and of two plates arranged between the feeding disk and the adjacent end of the rotary reed, fixed in position, parallel to the feed disk. The conveying of the filling thread to the fell of the cloth is effected, in the case of this filling thread clamping device, by the driving teeth of the feed disk and by clamping between the feed disk and one of the said plates.

This known filling-thread clamping device, in which the distance between the end of the rotary reed and the two plates arranged parallel to the feed disk or between the two plates is about 0.5 to at most 1.0 mm., is not sufficiently reliable due to the danger that, because of dirt and dust which has collected in these narrow spaces, the filling thread cannot be grasped and transported accurately. Another disadvantage of this known filling-thread clamping device is that its application to the rotary reed requires relatively difficult manipulations.

The closest prior art known to the applicant in connection with this application is in Swiss Pat. No. 530,495 and Swiss Pat. No. 557,442.

SUMMARY OF THE INVENTION

The present invention avoids the aforementioned disadvantages, and it is characterized by the fact that the filling-thread clamping device is formed by a tong-like thread gripper which is displaceable back and forth along a line lying in the central plane of the warp threads.

The proposed tong-like thread gripper is of simple construction, dependable in operation, and takes up little space. It can be mounted without great expense, even subsequently, on any undulated shed loom and it grasps every filling thread as long as the thread is offered to it in a somewhat stretched condition. By the additional provision of a suction nozzle directed against the filling thread to be grasped the proposed thread gripper can be used also in systems in which the filling thread to be grasped is not offered to the thread gripper in stretched condition. Thus the thread gripper proposed can be employed universally, regardless of the shuttle-filling and shuttle feed system selected.

BRIEF DESCRIPTION OF THE DRAWINGS

The invention will be described in further detail with reference to an example and the accompanying drawings, in which.

DESCRIPTION OF PREFERRED EMBODIMENT

Figure 1:
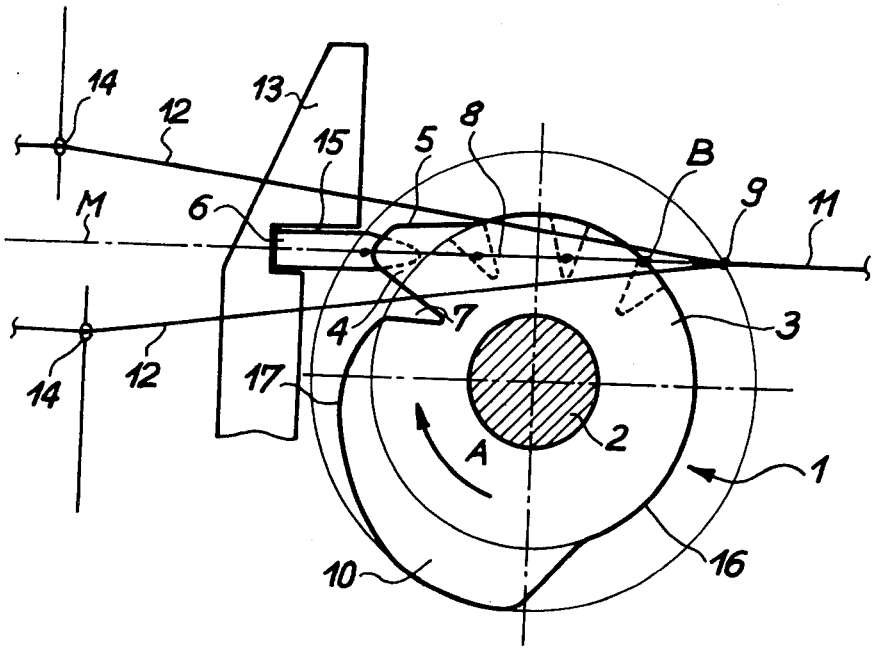
FIG. 1 is a cross-sectional view through the rotary reed of an undulated shed loom.

Referring to FIG. 1, the rotary reed 1, which rotates during operation in the direction of the arrow A, consists of a drive shaft 2 and of reed disks 3 spaced apart on the latter. Each reed disk 3 is provided on its periphery with a shuttle transport projection 4 having an oblique side 5 for the advance of the shuttles 6, a thread-transport slot 7 with an adjoining thread advance side 17 for the flattening feed of a filling thread 8 from its shuttle 6 to the fell of the cloth 9, a beating-up projection 10 for the beating-up of the filling thread 8, and a shuttle supporting part 16 of constant radius extending opposite the direction of rotation A from the end of the beating-up projection 10 to the oblique side 5.

All reed disks 3 are arranged at the same angle of rotation from each other along the drive shaft 2. In this way, the individual peripheral parts of the reed disks 3, when the latter rotate during operation in the direction indicated by the arrow A, produce a single-thread screw movement which extends from the one side of the loom to its other side.

The cloth is designated by 11 and the warp threads by 12. The warp threads 12, two of which are provided between every two adjacent reed disks 3, are guided from the fell of the cloth 9 by lamellae 13 to heddles 14, by which they are caused to form a shed.

Each shuttle 6 moves within a shed formed by the warp threads 12 thereby introducing a filling thread 8 into this shed. The direction of transport of the shuttles upon the insertion of the filling thread extends, with reference to the figure, perpendicular to the plane of the drawing, from front to rear, as seen by the viewer. The shuttles 6 are of elongated flat shape and have a beveled rear portion which serves for the driving of them. The longitudinal edges of the shuttles 6 which face the fell of the cloth 9 lie against a cylindrical circumferential part of the rotary reed 1 formed by the shuttle supporting parts 16 of the reed disks 3 and are thus supported by the rotary reed. In addition, the shuttles 6 are guided at their end facing away from the fell of the cloth 9 in a corresponding guide channel 15 of the lamellae 13, the said guide channel surrounding the shuttles 6 in U-shape.

During the operation of the loom, as already mentioned, the rotary reed 1 rotates in the direction of the arrow A, as a result of which the shuttle transport projections 4, the thread transport slots 7, the thread advance sides 17, the beating-up projections 10, and the shuttle supporting part 16 of the individual reed disks 3 produce, in their entirety, a screw-shaped movement progressing in one direction. Upon this rotary movement of the rotary reed 1, the oblique sides 5 of the shuttle transport projections 4 come against the beveled rear portion of the shuttles 6, press against said portion and thereby push the shuttles over the width of the loom synchronously to the screw movement of the transport projections 4. By means not shown in the drawing, the movement of the heddles 14 is so controlled that each shuttle 6, during its filling-introduction movement continuously enters into an open shed and a shed change takes place after each shuttle passage. The filling thread 8 coming from the shuttle 6 passes into the thread transport slot 7 and is transported along a path lying in the central plate M of the warp threads 12 up to the point B which lies in front of the fell 9 of the cloth. Thereupon the filling thread 8 is pushed further by the thread advance side 17 of the reed disks 3, which ascends from the thread transport slot 7 up to the beating-up projection 10, further under a flattened feed angle against the fell 9 of the cloth and is finally beaten up by the beating-up projection 10. The beating-up projection 10 is arranged at an angular distance from the thread transport slot 7 of about one-quarter revolution or, stated differently, from 70° to 110°. By means of this displacement of the beating-up projection 10 away from the thread transport slot 7 and by means of the thread advance side 20 the result is obtained that the filling thread 8 is fed to the fell 9 of the cloth at an angle of feed which is as flat as possible.

Figure 2:
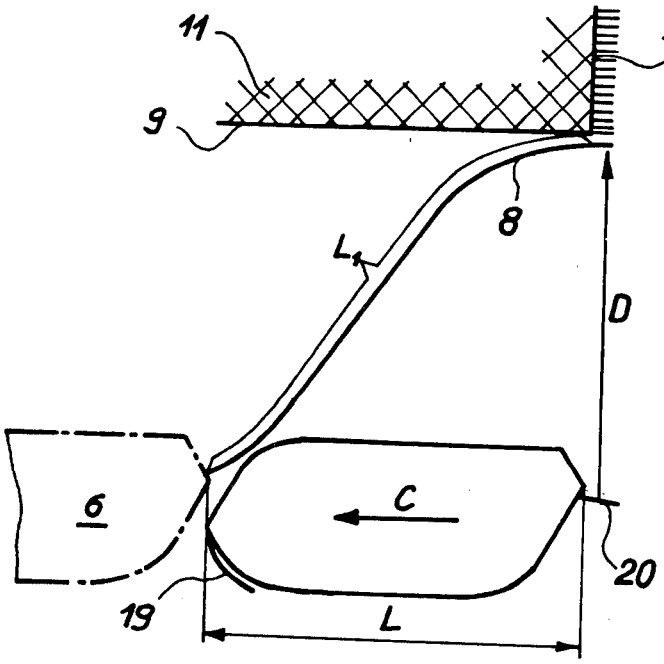
FIG. 2 is a schematic top view of a shuttle in the region of the insertion-side selvage showing a filling thread pulled away from the end of the shuttle.

FIG. 2 shows a schematic top view of a shuttle 6 in the region of the insertion-side selvage 18. The shuttle 6 is shown in two positions which are a distance apart from each other equal to one shuttle length L, the shuttle being shown in solid line in one position and in dash-dot line in the other position. For the sake of greater clarity of the drawing, only the shuttle 6, the filling thread 8 pulled away from it, and a part of the cloth 11 have been shown.

The shuttle 6 which is shown in solid line represents the position at which the shuttle 6 has fully entered the shed, having moved past the selvage 18. The direction of transport of the shuttle upon the insertion of the filling is indicated by C. As can be noted from FIG. 2, a short piece of the filling thread protrudes out of the front and rear ends of the shuttle 6, namely the so-called remaining end 19 on the front side and the so-called weaving-on end 20 of the filling thread on the rear side.

The shuttle 6 shown in dot-dash line represents that position of the shuttle in which the weaving-on end 20 of the filling thread 8 extending out of the shuttle in question is just beaten-up against the fell 9 of the cloth in the region of the selvage 18.

While the shuttle 6 is transported by the distance L from its position shown in solid line into its position shown in dot-dash line, the weaving-on end 20 of the filling thread 8 must be conveyed perpendicular to the shuttle transport direction C along the straight line D to the fell 9 of the cloth. In this connection, filling thread 8 of the length $L_1$ must be supplied by the shuttle 6.

As can be readily noted from FIG. 2, the length of filling thread $L_1$ withdrawn from shuttle 6 in the case of the shuttle position shown in dot-dash line, namely the length of the filling thread from the selvage 18 to the shuttle 6 in the position shown in dot-dash line, is greater than the shuttle transport length L from the selvage 18 up to the said shuttle position. This means that the weaving-on end 20, during its transportation from the shuttle in the position shown in solid line along the straight line D to the selvage 9 and until it is beaten up against same must be held fast and positively guided by additional means.

If the weaving-on end 20 were held only by the rotary reed 1 (FIG. 1) during this time and not by additional means then, in the case of the shuttle position shown in dot-dash line, the filling thread 8 would be withdrawn from the shuttle 6 only in a length equal to the shuttle transport length L and the weaving-on end 20 would be pulled by the difference $L_1$ - L from the selvage 18 into the inside of the cloth.

Figure 3:
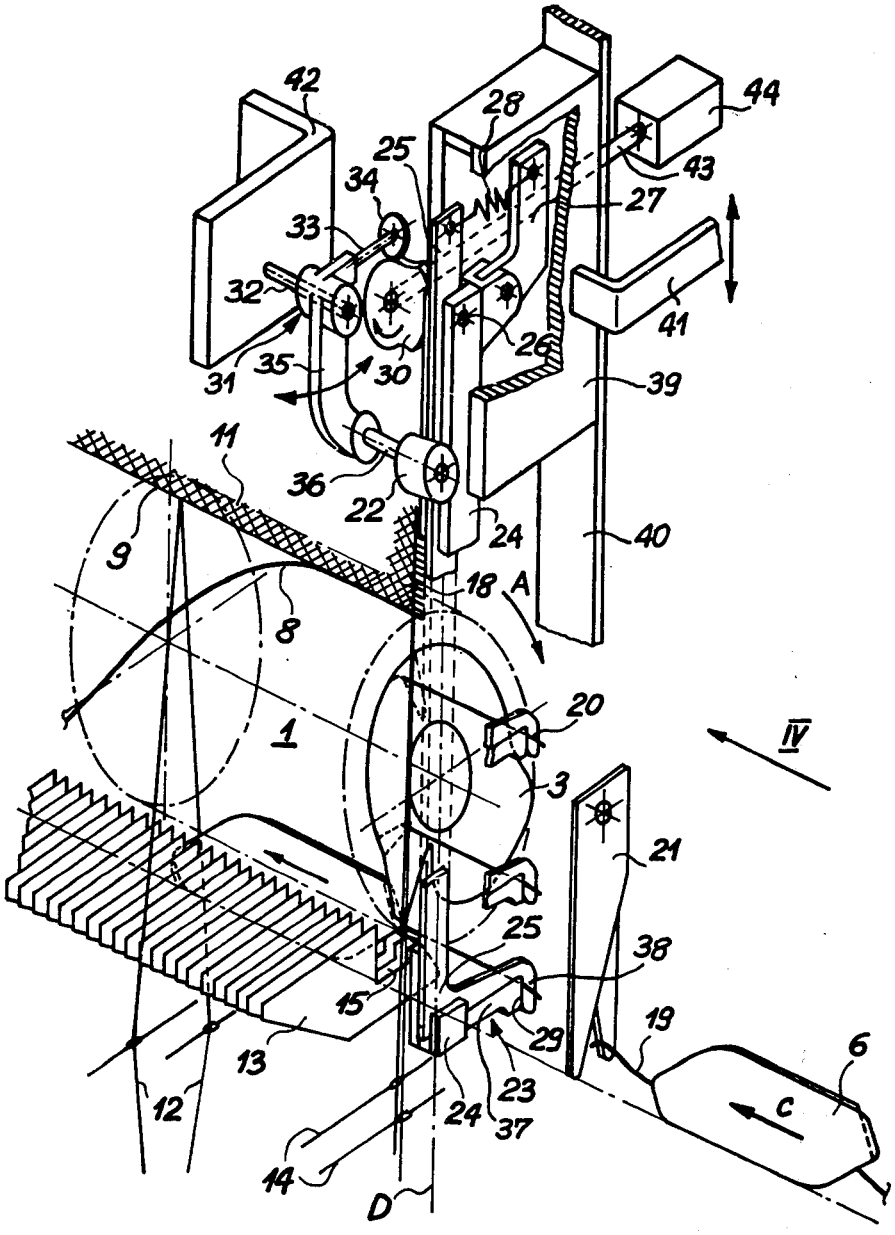
FIG. 3 is a perspective view of the end surface of the rotary reed shown in FIG. 1, provided with a filling-thread clamping device.

The additional means for the clamping of the weaving-on end 20 of the filling thread 8 will now be described, with reference to FIG. 3:

In the case of the apparatus shown in FIG. 3, the shuttles 6, delivered by a shuttle filling device (not shown) to the insertion side of the loom, are connected together by a filling thread. Only after a shuttle has been inserted into the guide sheet formed by the lamellae 13 is the filling thread, which extends from the rear of the inserted shuttle to the front of the next following shuttle, cut by shears 21, arranged at a distance from the face of the rotary reed 1. In this way, as already mentioned, a weaving-on end 20 is produced in the case of the inserted shuttle and a residual end 19 of the filling thread 8 is produced in the case of the next following shuttle. The residual end must be as short as possible in order to avoid being possibly woven-in.

Between the insertion-side surface of the rotary reed 1 and the shears 21 there is arranged a tong-shaped thread gripper 23 which is displaceable back and forth along a straight line D, lying in the central plane M (FIG. 1) of the warp threads 12 and parallel to the warp threads. The distance between the face of the rotary reed 1 and the thread gripper 23 between thread gripper 23 and shears 21 has been made exaggeratedly large in the figure for purposes of greater clarity. Actually, each of these distances is only a few millimeters. Accordingly, the length of the piece of filling thread extending from the face of the rotary reed 1 to the thread gripper 23 is also considerably smaller than shown in the figure and also amounts to only a few millimeters.

The thread gripper 23 consists essentially of an elongated L-shaped guide part 24 and an elongated L-shaped clamping arm 25 swingably supported in said guide part. The clamping arm 25 is bent at end 38 of its short arm around the free end of short arm 37 of the guide part 24. This bent end 38 of the clamping arm 25 and the free end of the short arm of the guide part 24 form the actual clamping part 29 of the thread gripper 23. The control and actuation of the reciprocating movement of the thread gripper 23 is effected by a cam disk, not shown.

The long arm of the guide part 24 is provided with a continuous longitudinal groove which extends up to close to its face surfaces, in which groove the long arm of the clamping arm 25, which is made of relatively thin sheet metal and supported on a pivot pin 26 in the region of the free end of the guide part 24, is guided. The free end of the long arm of the clamping arm 25 extends out of the guide part 24. To the free end of the long arm of the guide part 24 there is pivoted an angle arm 27 to which a tension spring or biasing means 28, fastened to the free end of the long arm of the clamping arm 25, is attached. By the action of the tension spring 28, the clamping part 29 of the thread gripper 23 is pressed together.

For the opening and closing of the clamping part there is provided a double-armed cam lever 31 controlled by a cam 30. Cam lever 31 and cam 30 are associated, fixed in position, with the thread gripper 23 and thus also participate in the reciprocating motion of the thread gripper. The cam lever 31 is supported in its central part on a pivot pin 32, which is supported by a bearing 42 connected with the frame of the weaving machine, the pivot pin being arranged parallel to the shuttle transport direction C. The first lever arm 33 is oriented perpendicular to the plane of the cam 30 and on its free end bears a roller 34 which travels on the periphery of the cam 30. The cam 30 is mounted on a shaft 42 and operated by a drive mechanism 44 which is mounted on the frame of the weaving machine. The second lever arm 35 is perpendicular to the first lever arm 33 and perpendicular to the shaft 32 and is provided on its free end with a shaft 36 which is directed parallel to the pivot axis 32 of the control arm 31. On the free end of the shaft 36 there is arranged a cam roller or control element 22 which rests on the longitudinal edge of the clamping arm 25 which faces away from the angle arm 27, in such a manner that the pivot pin 26 of the clamping arm 25 lies between the points of action of the tension spring 28 and the cam roller 22. The cam roller 22 thus opposes the force of the tension spring 28 and, controlled by the cam disk 30, effects the opening and closing of the clamping part 29.

It will be appreciated that the thread gripper 23 consisting of guide part 24, clamping arm 25, angle arm 27 and tension spring 28 is mounted in a housing 39 that is movable back and forth along a guide bar 40 by a lever 41, the lever 41 being connected to a suitable driving mechanism (not shown), all of which form a drive means. A suitable driving mechanism for lever 41, for example, is shown in U.S. Pat. No. 3,263,705, FIGS. 7, 10, and 16, wherein a mechanism for driving a shuttle pushing member 86 is illustrated. This known shuttle pushing member is used on the undulated shed loom according to the subject invention and the movement of the shuttle pushing member is also back and forth along line D and synchronous to the movement of lever 41.

Figure 4:
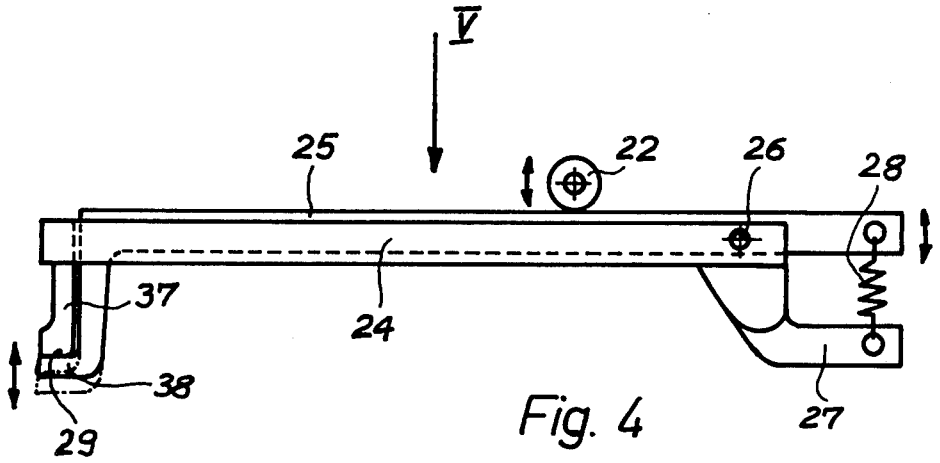
FIG. 4 is a schematic side view of the gripping device shown in FIG. 3 as seen in the direction of the arrow IV of FIG. 3.
Figure 5:
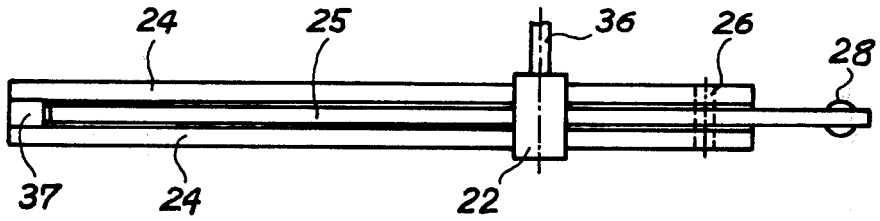
FIG. 5 is a top view as seen in the direction of the arrow V of FIG. 4.

As can be seen in FIGS. 4 and 5, Angle arm 27 is rigidly mounted on the free end of the long arm of guide part 24. Tension spring 28 pulls the free end of the long arm of the clamping arm 25 against the angle arm 27 and presses the free end of the short arm 37 of guide part 24 and the bent end 38 of clamping arm 25 together, therefore closing the actual clamping part 29 of the thread gripper 23. Guide part 24 consists of two spaced, elongated and parallel strips of relatively thin sheet material forming the long arm and of a single strip forming the short arm 37. The short arm is mounted between the two strips at the one end of the long arm. The two strips of the long arm of guide part 24 form a guide for clamping arm 25, the clamping arm being arranged in the space between the two strips and being supported on the pivot pin 26.

As can best be seen from FIGS. 4 and 5, the edge of clamping arm 25 neighbored to cam roller 22 surmounts the long arm of guide part 24 therefore enabling cam roller 22 to press against said edge and moving clamping arm 25. FIG. 4 shows the opened position of actual clamping part 29 in dash-dot line.

The reciprocating motion of the thread gripper 23 along the straight line D, the displacement of the weaving-on end 20 in the plane M (in FIG. 1) by the rotating thread transport slot 7, the cutting movement of the shears 21, and the rotation of the cam 30 have synchronized drive means so that they are so synchronized with each other that, from the insertion of a shuttle 6 into the guide channel 15, the following process steps take place in the following sequence:

Shortly before the cutting off of the filling thread 8 between the shuttle 6 inserted into the channel 15 and the next following shuttle by means of the shears 21, the clamping part 29 of the thread gripper 23 grasps the filling thread and clamps it fast.

Immediately after the filling thread 8 has been cut off, the thread gripper 23 begins its reciprocating motion along the straight line D and transports the firmly clamped weaving-on end of the filling thread in the direction towards the fell 9 of the cloth.

The weaving-on end 20 reaches the fell 9 of the cloth synchronously with the adjoining filling thread part transported by the thread transport slot 7 of the adjacent reed disk 3 of the rotary reed 1.

After the filling thread 8 has been beaten up in the region of the selvage 18, the clamping part 29 of the thread gripper 23 is opened via the cam roller 22, the cam lever 31, the roller 34, and the cam 30.

The thread gripper 23 moves back along the straight line D with the clamping part 29 open to grip the filling thread 8 between the first following and the second following shuttle 6.

In order that the filling thread 8 may be reliably grasped by the thread gripper 23, the part of the filling thread to be grasped must be offered the thread gripper in reasonably stretched form. In the embodiment shown in FIG. 3, this is done in the manner that after the filling of the shuttles 6 the filling thread 8 is not cut off immediately but rather it is conducted further up to the next shuttle. The filling-thread connecting piece thus produced between two successive shuttles 6 and which is cut off only after it is grasped by the thread gripper 23, can be grasped conveniently and dependably by the thread gripper 23.

The thread gripper described can however also be used in combination with shuttle-filling devices in which the filling thread is cut off immediately after the filling of the shuttle. In this case, in the case of the arrangement shown in FIG. 3, the shears 21 must be replaced by a suction nozzle directed against the weaving-on end 20 of the filling thread 8, upon the actuation of which nozzle the weaving-on end 21 which is to be grasped by the thread gripper 23 is sufficiently stretched.

Although the thread gripper of the invention has been shown in the figures on an undulated shed loom with rotary reed, its use is by no means limited to undulated shed looms of this type. Rather, the thread gripper can be used on all undulated shed looms, regardless of the nature of the filling-thread beating-up means.

It will be appreciated that various changes and/or modifications may be made within the skill of the art without departing from the spirit and scope of the invention illustrated, described, and claimed herein.

What is claimed is:

1. An undulated shed loom having an end of the shed a filling thread insertion point and a filling thread clamping device arranged at the insertion end of the shed and adapted to clamp the filling thread fast behind each shuttle, to convey said filling-thread part to the fell of the cloth, and to hold the filling thread fast until it is woven into cloth, characterized by the fact that the filling-thread clamping device is formed by a tong-like thread gripper having drive means for reciprocating said tong-like gripper along a straight line lying in a central plane of the warp threads, said thread clamping device arrangement comprising an elongated L-shaped guide part and an elongated L-shaped clamping arm swingably supported in said guide part, and the free end of the short arm of said clamping arm is bent around the free end of the short arm of the guide part and, together with the end of the last-mentioned arm, forms the actual clamping part of said thread gripper.

2. The undulated shed loom according to claim 1 in which the clamping arm is a double-armed lever, and a biasing means which closes the actual clamping part of the thread gripper is operatively arranged between the free end of the one lever arm of said clamping arm and the long arm of said guide part.

3. The undulated shed loom according to claim 2 in which a control element for counteracting the force of the biasing means presses against said clamping arm and is arranged along a longitudinal edge of said clamping arm in the region of the other lever arm of the said clamping arm bearing said short arm.

4. The undulated shed loom according to claim 3 in which the control element is a roller pressing against said clamping arm and supported on a swing lever which is arranged in fixed position relative to the thread gripper and is operated by a driven cam disk.

5. The undulated shed loom according to claim 4 in which the driven cam disk is synchronized with the drive means of said thread gripper which produces its reciprocating motion.

* * * * *